US005199508A

United States Patent [19]

Miyanaga

[11] Patent Number: 5,199,508

[45] Date of Patent: Apr. 6, 1993

[54] ROTARY HAMMER DRILL

[75] Inventor: Masaaki Miyanaga, Ashiya, Japan

[73] Assignee: Kabushiki Kaisha Miyanaga, Japan

[21] Appl. No.: 739,224

[22] Filed: Aug. 1, 1991

[51] Int. Cl.[5] ..... B23B 31/06

[52] U.S. Cl. ..... 173/211; 173/104; 279/82; 279/157; 408/226

[58] Field of Search ..... 173/47, 48, 104, 139, 173/210, 211; 279/157, 158, 1 M E, 1 R, 82; 408/226

[56] References Cited

U.S. PATENT DOCUMENTS

| | | | |
|---|---|---|---|
| 2,963,298 | 12/1960 | Better et al. | 279/157 |
| 3,921,729 | 11/1975 | Schmuck | 173/104 |
| 4,131,165 | 12/1978 | Wanner et al. | 173/133 |
| 4,274,774 | 6/1981 | Haga et al. | 279/158 |
| 4,898,250 | 2/1990 | Neumaier et al. | 173/104 |

FOREIGN PATENT DOCUMENTS

| | | | |
|---|---|---|---|
| 451699 | 10/1927 | Fed. Rep. of Germany | 279/1 R |
| 825329 | 11/1951 | Fed. Rep. of Germany | 279/1 M E |
| 2094189 | 9/1982 | United Kingdom | 279/1 R |
| 2137122 | 10/1984 | United Kingdom | 279/1 R |

*Primary Examiner*—Frank T. Yost
*Assistant Examiner*—Scott A. Smith
*Attorney, Agent, or Firm*—Marshall, O'Toole, Gerstein, Murray & Bicknell

[57] ABSTRACT

An adaptor for attaching a bit to a rotary hammer drill and for attenuating the hammering force from the drill to the bit. The adaptor comprises a tubular body for engagement with the shank of a drill bit, the body having a closed rear end. Means is provided within the body at the closed end for engagement with the rear end of the shank of the drill bit to attenuate the hammering force.

2 Claims, 3 Drawing Sheets

ROTARY HAMMER DRILL

FIELD AND BACKGROUND OF THE INVENTION

This invention relates to a rotary hammer drill, and particularly to an adaptor for attaching a bit to the drill.

Concrete or rock is drilled using a rotary hammer drill having a bit which is both reciprocated and rotated. A conventional rotary hammer drill has a bit secured directly to a chuck on the drive shaft of the drill. The forward end of the shaft engages with the rear end of the bit to transmit the hammering force from the drill to the bit.

Generally in a rotary hammer drill, the rotational speed is variable, but the hammering force is not adjustable. Consequently if the bit is thin, it may be broken by an excessively strong hammering force.

SUMMARY OF THE INVENTION

It is a general object of the invention to provide an adaptor for attaching a bit to a rotary hammer drill and for attenuating the hammering force from the drill to the bit.

An adaptor according to this invention is adapted to be coupled to a rotary hammer drill, and comprises a tubular body for engagement with the shank of a drill bit. The body has a closed rear end. Means is provided within the body at the closed end for engagement with the rear end of the shank to attenuate the hammering force.

BRIEF EXPLANATION OF THE DRAWINGS

Preferred embodiments of the invention are shown in the accompanying drawings, wherein.

DETAILED DESCRIPTION OF THE INVENTION

Figure 1:
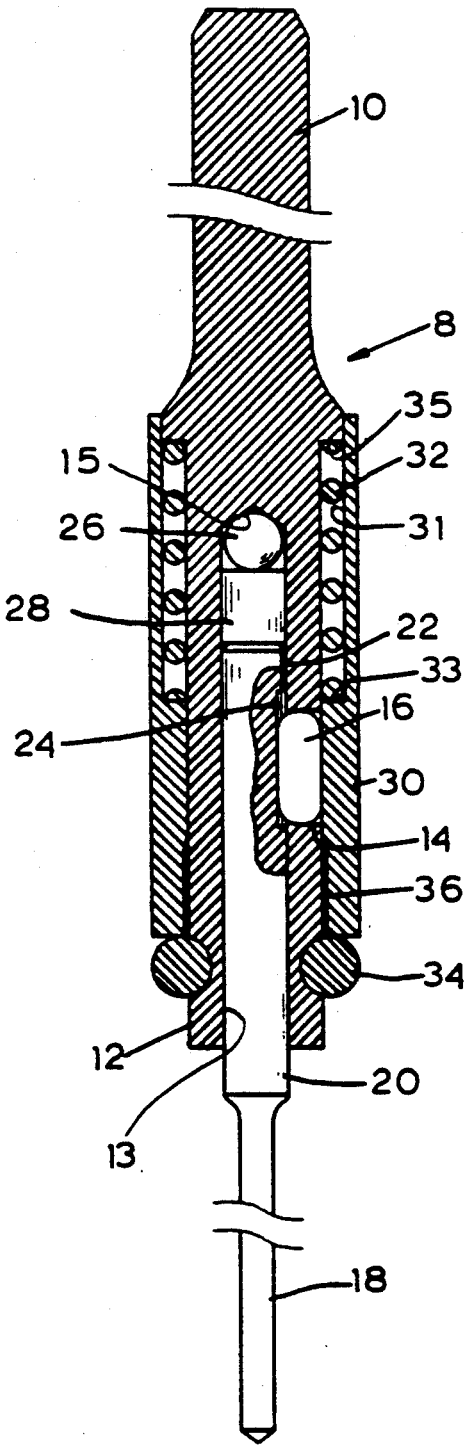
FIG. 1 is a side view mostly in axial section of an adaptor and a drill bit according to a preferred embodiment of this invention.
Figure 2:
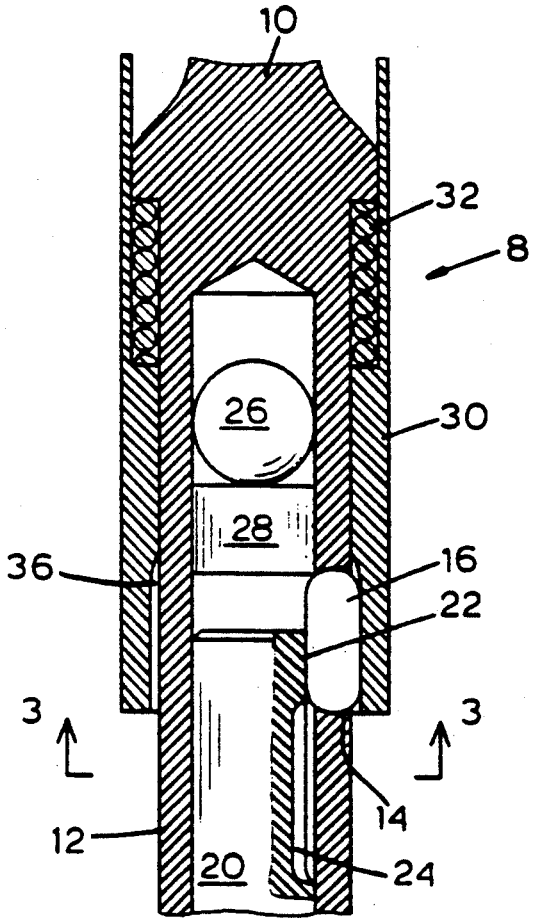
FIG. 2 is an enlarged fragmentary side view mostly in axial section of the adaptor and the drill bit in a different position.
Figure 3:
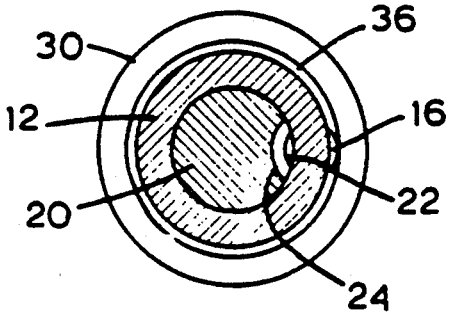
FIG. 3 is a sectional view on line 3—3 of FIG. 2.

With reference to FIGS. 1-3, the adaptor 8 includes a shank 10 adapted to be secured to a chuck (not shown) on the drive shaft of a rotary hammer drill. The shank 10 terminates at the forward end thereof in a cylinder 12 having an open tubular forward end forming an axial opening 13. The cylinder 12 has a slot 14 formed through its side wall to support an axially elongated roller 16 at a location which is spaced from the forward end.

The roller 16 has a diameter larger than the thickness of the cylinder 12 side wall, and it has semispherical ends. The slot 14 is narrowed on the radially inner side to keep the roller 16 from falling radially inwardly.

The drill bit 18 has a cylindrical shank 20 at its rear end for telescopic engagement into the axial opening 13 of the cylinder 12. The shank 20 has a continued and axially aligned contiguous series of shallower and deeper axial grooves 22 and 24 (see FIGS. 2 and 3).

A metal ball 26 and a cylindrical metal roller 28 are slidable in the cylinder 12 at the inner end 15 of the opening 13 and interposed between the inner end 15 of the opening 13 and bit shank 20. The ball 26 and the roller 28 are elastically deformable to attenuate the hammering force. The types of material of the ball 26 and the roller 28 may be selected, depending on the strength of bit 18, to transmit a suitable hammering force to the bit. As an example, hardened steel may be used for the parts 26 and 28.

An outer sleeve 30 telescopically surrounds the cylinder 12, and is urged forwardly by a compression spring 32, but its forward movement is limited by an annular stop ring 34 fixed to the exterior of the cylinder 12 near its forward end. The sleeve 30 has a forward end portion with its inner diameter enlarged to form a circumferential recess or space 36. The upper end of the sleeve 30 is counterbored as at 31 which forms a ledge 33, and the spring 32 fits in the counterbore 31 between the ledge 33 and a shoulder 35 formed on the cylinder 12 adjacent the shank 10. The sleeve 30 and the ring 34 are preferably made of rubber while the other parts are preferably made of metal.

Normally as shown in FIG. 1, the portion of the sleeve 30 between the counterbore 31 and the space 31 keeps a portion of roller 16 projecting from the slot 14 into the deeper groove 24 of bit shank 20, so as to lock the shank 20 to the cylinder 12 to transmit the torque from the cylinder 12 to the bit 18 when the shank 10 is rotated.

In this position, the ball 26 add roller 28 can transmit the hammering force from the shank 10 to the shank 20, which is somewhat attenuated by the elastic deformation of ball 26 and roller 28, gaps between parts, etc. A larger number of parts (such as the parts 26 and 28) between the shank 10 and the shank 20 increases the amount of attenuation of the hammering force. The parts 26 and 28 are shaped (being in this example a ball and a flat-ended cylinder) to conform generally to the adjacent surfaces of the shanks 10 and 12, thereby reducing wear on the adjacent parts.

The bit 18 can be pulled out for replacement by first manually moving the sleeve 30 rearwardly against the force of spring 32, as shown in FIG. 2, so that the roller 16 may shift radially out and move a portion of it into the circumferential space 36, with another portion still projecting in the cylinder 12. The bit 18 is then pulled out, with the shallower groove 22 sliding over the roller 16.

After the bit 18 is removed, the ball 26 and the roller 28 are held within the cylinder 12 by engaging with the inner side of the roller 16. They can, however, be replaced by first removing the ring 34, sleeve 30 and roller 16.

Figure 4:
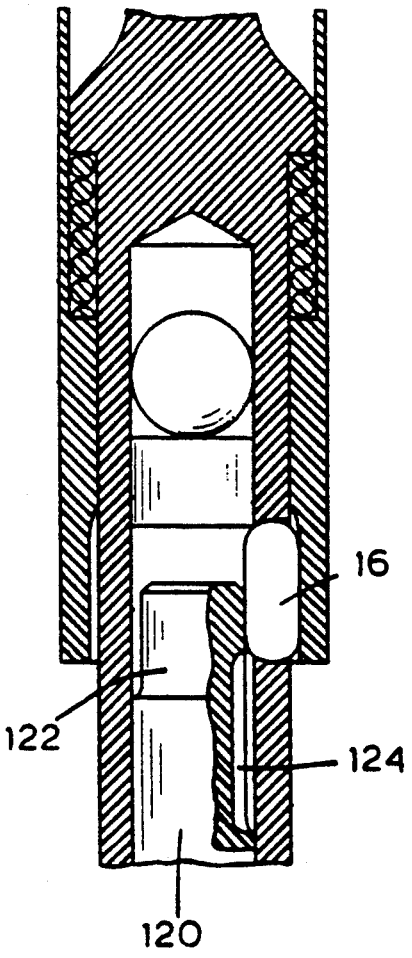
FIG. 4 is a view similar to FIG. 2, but showing another embodiment of the invention.

FIG. 4 shows an alternative embodiment, wherein the bit shank 120 has a rear end portion 122 reduced in diameter, instead of a shallower groove 22 as shown in FIGS. 1-3, to pass over the roller 16. The shank 120 has an axial groove 124 extending partially in the end portion 122. The groove 124 is deeper than the portion 122.

What is claimed is:

1. A rotary hammer drill comprising:

a tubular body adapted to be rotated and reciprocated, the body having a closed rear end, an open forward end, and a peripheral wall having a slot formed therethrough;

a bit having a shank at its rear end for telescopic engagement into said forward end of said tubular body, the shank having an outer recess formed in its peripheral wall spaced from its rear end;

elastically deformable means for engagement within the tubular body between the rear ends of said body and said shank;

a sleeve telescopically engaging around said tubular body and having an inner recess formed in its inner peripheral wall adjacent its forward end;

a spring interposed between the tubular body and sleeve to urge the sleeve forwardly relative to the body;

a stop on said tubular body for engagement with said sleeve to limit the forward movement of said sleeve, so that said inner recess of said sleeve is normally not aligned with said slot of said tubular body; and connecting means engaging movably with said slot and normally with the inner wall of said sleeve and with the outer recess of said shank;

said connecting means being adapted, when said sleeve has been moved rearwardly to align said inner recess with said slot, and said shank is pulled forwardly, to shift radially out away from said outer recess to said inner recess, said connecting means comprising a roller having a diameter large enough for a portion of said roller to project radially in from said slot even when said roller engages with the inner recess of the sleeve, so that said deformable means may engage with said roller so as not to fall out of said tubular body;

said slot being narrowed on its radially inner side to keep said roller from falling into said tubular body; and said shank of said bit having another recess which is shallower than said outer recess, and which extends in the peripheral wall of the shank between its rear end and the deeper outer recess, so that said shallower recess passes over said roller when said roller engages with said inner recess.

2. A rotary hammer drill comprising:

a tubular body adapted to be rotated and reciprocated, the body having a closed rear end, an open forward end, and a peripheral wall having a slot formed therethrough;

a bit having a shank at its rear end for telescopic engagement into said forward end of said tubular body, the shank having an outer recess formed in its peripheral wall spaced from its rear end;

elastically deformable means for engagement within the tubular body between the rear ends of said body and said shank;

a sleeve telescopically engaging around said tubular body and having an inner recess formed in its inner peripheral wall adjacent its forward end;

a spring interposed between the tubular body and sleeve to urge the sleeve forwardly relative to the body;

a stop on said tubular body for engagement with said sleeve to limit the forward movement of said sleeve, so that said inner recess of said sleeve is normally not aligned with said slot of said tubular body; and connecting means engaging movably with said slot and normally with the inner wall of said sleeve and with the outer recess of said shank;

said connecting means being adapted, when said sleeve has been moved rearwardly to align said inner recess with said slot, and said shank is pulled forwardly, to shift radially out away from said outer recess to said inner recess, said connecting means comprising a roller having a diameter large enough for a portion of said roller to project radially in from the slot even when the roller engages with the inner recess of the sleeve, so that said deformable means may engage with said roller so as not to fall out of said tubular body;

said slot being narrowed on its radially inner side to keep said roller from falling into said tubular body; and said shank of said bit having a rear end portion extending between its rear end and its outer recess, said rear end portion having a reduced diameter large enough to normally keep said roller engaging with said outer recess of said shank, but small enough for said roller to disengage from said outer recess when said roller engages with said inner recess.

* * * * *